US010350785B2

(12) United States Patent
Costa et al.

(10) Patent No.: US 10,350,785 B2
(45) Date of Patent: Jul. 16, 2019

(54) USE OF PTFE SHEET IN MANUFACTURING WOOD-BASED PRODUCTS

(71) Applicant: Norbord Inc., Toronto (CA)

(72) Inventors: Jaime Antonio Costa, Maple Ridge (CA); Bruce Warren Grunert, Kamloops (CA)

(73) Assignee: Norbord Inc., Toronto, Ontario (CA)

( * ) Notice: Subject to any disclaimer, the term of this patent is extended or adjusted under 35 U.S.C. 154(b) by 4 days.

(21) Appl. No.: 14/386,896

(22) PCT Filed: May 24, 2013

(86) PCT No.: PCT/CA2013/000235
§ 371 (c)(1),
(2) Date: Sep. 22, 2014

(87) PCT Pub. No.: WO2013/138902
PCT Pub. Date: Sep. 26, 2013

(65) Prior Publication Data

US 2015/0054205 A1 Feb. 26, 2015

Related U.S. Application Data

(60) Provisional application No. 61/614,810, filed on Mar. 23, 2012.

(51) Int. Cl.
*B27N 3/14* (2006.01)
*B27N 3/08* (2006.01)
*B27N 3/02* (2006.01)

(52) U.S. Cl.
CPC ..... *B27N 3/143* (2013.01); *B27N 3/02* (2013.01); *B27N 3/083* (2013.01)

(58) Field of Classification Search
CPC . B27N 3/02; B27N 3/083; B27N 3/14; B27N 3/143
See application file for complete search history.

(56) References Cited

U.S. PATENT DOCUMENTS 2,166,745 A * 7/1939 Appel ..... E06B 9/82 160/298
3,070,842 A * 1/1963 Fuller ..... B27N 3/203 100/115

(Continued)

FOREIGN PATENT DOCUMENTS

WO WO-1999/06210 2/1999
WO WO 2013/138902 A1 9/2013
WO WO-2013138902 A9 9/2013

OTHER PUBLICATIONS

Suchsland et al., "Fiberboard Manufacturing Practices in the United States," United States Department of Agriculture Forrest Service, Agriculture Handbook No. 640 (1986).*

(Continued)

*Primary Examiner* — Michael N Orlando
*Assistant Examiner* — Cynthia L Schaller
(74) *Attorney, Agent, or Firm* — Schwegman Lundberg & Woessner, P.A.

(57) ABSTRACT

The present invention provides for methods of manufacturing wood-based composite products, articles of manufacture employed in the manufacturing of wood-based products (e.g., PTFE sheet configured to be attached to platen and/or platen configured to attach to PTFE sheet), systems used in the manufacturing of wood-based products (e.g., platens having PTFE sheet attached thereto), methods of using such articles of manufacture, methods of using such systems, and wood-based products (e.g., OSB, PB, MDF and/or HDF) obtained from such methods.

20 Claims, 14 Drawing Sheets

(56) References Cited

U.S. PATENT DOCUMENTS 3,684,613 A * 8/1972 Frohning ..... B30B 15/026 100/132
4,374,791 A * 2/1983 Farrissey ..... B27N 3/083 264/109
4,416,170 A * 11/1983 Gibson ..... B23P 15/24 156/219
4,792,426 A * 12/1988 Greatorex ..... B29C 43/228 264/280
4,816,103 A * 3/1989 Ernest ..... B27D 1/083 100/202
4,913,639 A * 4/1990 Wheeler ..... B27N 3/06 100/295
5,477,901 A * 12/1995 Schikarski ..... B27N 3/22 156/264
6,544,649 B1 4/2003 Troughton
6,562,479 B1 * 5/2003 Smalley ..... B27N 3/083 428/532
6,737,155 B1 5/2004 Ou
2005/0238865 A1 10/2005 Konishi
2009/0061189 A1 3/2009 Ou et al.
2011/0024435 A1 * 2/2011 MacNabb ..... B65D 88/52 220/666

OTHER PUBLICATIONS

"International Application No. PCT/CA2013/000235, International Search Report dated May 21, 2013", 3 pgs.
"International Application No. PCT/CA2013/000235, Written Opinion dated May 21, 2013", 7 pgs.
"European Application Serial No. 13763577.7, Office Action dated Mar. 14, 2016", 6 pgs.
"European Application Serial No. 13763577.7, Office Action dated Aug. 16, 2016", 9 pgs.
"International Application Serial No. PCT/CA2013/000235, International Preliminary Report on Patentability dated Oct. 2, 2014", 8 pgs.
"U.S. Appl. No. 14/386,896, Response filed Sep. 14, 2017 to Final Office Action dated Jun. 14, 2017.", 8 pgs.

* cited by examiner

| | Anchor Qty. | Tool Qty. | Total Qty. |
|---|---|---|---|
| 4 5/8" | (2) | (2) | (4) |
| 5 1/4" | (23) | (4) | (27) |
| 6 5/8" | (2) | (2) | (4) |

USE OF PTFE SHEET IN MANUFACTURING WOOD-BASED PRODUCTS

CROSS REFERENCE TO RELATED APPLICATIONS

The present patent application is a U.S. National Stage Application under 35 U.S.C. 371 from International Application No. PCT/CA2013/000235, filed Mar. 15, 2013, published on Sep. 26, 2013 as WO 2013/138902 A1 which claims the benefit of priority to U.S. Provisional Patent Application No. 61/614,810, filed Mar. 23, 2012, both of which are hereby incorporated herein by reference in their entirety.

BACKGROUND OF THE INVENTION

Wood-based panel products are used in a wide-variety of applications throughout the world. These applications include commodity structural sheathing for wood construction (e.g., roofs, walls, sub-floors), value-added engineered structural panels/structural composite lumber (e.g., oriented strand lumber (OSL), laminated strand lumber (LSL), parallel strand lumber (PSL), rimboards, webstock for I-Joists, stair stringers, and stair tread), and non-structural core stocks (e.g., decorative panels, furniture, doors and door parts). There are two main types of structural sheathing panels used in structural applications: oriented strand board (OSB) and plywood. The main types of panels used on non-structural applications include particle board, medium density fiberboard (MDF), and high density fiberboard (HDF).

All of these engineered wood products are manufactured with "thermosetting" resins that require cure time in a hot press while under pressure. For this reason, they are made almost exclusively with resins that will not stick to the hot steel of the press, particularly in the surface layers that are directly exposed to the hot press (typically referred to as "platens"). There are a few resins that are commonly used in these applications because they do not stick to the press platens. These resins include: liquid phenol-formaldehyde (LPF), powder phenol-formaldehyde (PPF), urea-formaldehyde (UF), melamine-urea-formaldehyde (MUF), and melamine-urea-phenol-formaldehyde (MUPF).

Another wood binder called MDI (methylene diphenyl diisocyanate or diisocyanate-diphenylmethane) is sometimes used in the manufacture of these products because of its superior binding properties (e.g., can cure under higher moisture conditions, cures relatively quickly, cures at lower temperatures, and has a relatively light color). However, it has an incredible propensity to stick to hot metal. This is especially problematic with the top surface of a panel of a hot press (platen) for each press opening in a multi-opening press. In contrast, the bottom portion of each press opening is not as problematic, because the bottom portion of each press opening of the multi-opening hot press includes a screen, which is flexible and moves over rollers as the panel is moved off the screen.

The propensity of MDI to stick to hot metal typically results in spraying a release agent on the uncured mats before the mats enter the press. This method carries a significant potential risk because if any spot is missed with the release agent spray, would have the risk of sticking to the press and the line must be shut down to remove the panel (e.g., to grind the portion of the panel stuck to the platen off).

Unfortunately, even when they work, there are side-effects with the use of release agents (e.g., soap-based, silicone-based, sugar-based or lipid-based release agents). The silicone-based release agents build up the press surface and eventually interfere with panel pressing in terms of thickness variation and thermal transfer. To avoid this, "soap" based release agents (e.g., potassium oleate) are used, as they are completely sacrificed during the hot pressing. The issue with the soap-based release agents is that they leave a dark discoloration on the surface of the panel that some customers find unsightly. In heavier applications of soap release, excessive smoke is released at the press, and the panels pick up a slight odor that can be offensive.

SUMMARY OF THE INVENTION

The present invention provides for wood-based products (e.g., OSB, PB, MDF and/or HDF), methods of manufacturing wood-based composite products, articles of manufacture employed in the manufacturing of wood-based products (e.g., PTFE sheet configured to be attached to platen and/or platen configured to attach to PTFE sheet), systems used in the manufacturing of wood-based products (e.g., platens having PTFE sheet attached thereto), methods of using such articles of manufacture, and methods of using such systems.

The present invention provides for a sheet that includes a substrate having a pair of opposing sides. At least one of the opposing sides of the substrate is coated with polytetrafluoroethylene (PTFE). Additionally, the sheet is configured to attach to a hot press. The hot press is employed in the manufacture of wood-based products (e.g., OSB, PB, MDF and/or HDF).

The present invention provides a method of manufacturing a wood-based product (e.g., plywood). The method includes: (i) contacting one or more opposing sides of veneers of wood with a resin; (ii) orienting, in substantially alternate lengthwise and crosswise layers, the veneers of wood to provide a pile of substantially oriented veneers; (iii) contacting the pile of substantially oriented veneers with a sheet comprising a substrate having a pair of opposing sides, wherein at least one of the opposing sides of the substrate is coated with polytetrafluoroethylene (PTFE); (iv) contacting a surface of the sheet comprising the polytetrafluoroethylene (PTFE) with the top surface of a hot press; and (v) curing the resin by exposing the resin to at least one of an elevated temperature, an elevated pressure, and radiant energy; for a sufficient period of time; to effectively cure the resin.

The present invention provides a method of manufacturing a wood-based product (e.g., particle board (PB). The method includes: (i) contacting particles of wood with a resin; (ii) forming a blanket of particles of wood; (iii) contacting the blanket of particles of wood with a sheet comprising a substrate having a pair of opposing sides, wherein at least one of the opposing sides of the substrate is coated with polytetrafluoroethylene (PTFE); (iv) contacting a surface of the sheet comprising the polytetrafluoroethylene (PTFE) with the top surface of a hot press; and (v) curing the resin by exposing the resin to at least one of an elevated temperature, an elevated pressure, and radiant energy; for a sufficient period of time; to effectively cure the resin.

The wood-based product includes particle board (PB), oriented strand board (OSB), medium density fiberboard (MDF), Oriented Strand Lumber (OSL), Laminated Strand Lumber (LSL), and Parallel Strand Lumber (PSL)

The present invention also provides for a method of manufacturing an oriented strand board (OSB). The method includes: (i) contacting flakes of wood with a resin; (ii) orienting, in substantially alternate lengthwise and crosswise layers, the flakes of wood to provide a blanket of substantially oriented flakes; (iii) contacting the blanket of substantially oriented flakes with a sheet described herein; (iv) contacting a surface of the sheet comprising the polytetrafluoroethylene (PTFE) with the top surface of a hot press; and (v) curing the resin by exposing the resin to at least one of an elevated temperature, an elevated pressure, and radiant energy; for a sufficient period of time; to effectively cure the resin.

In employing the PTFE sheet of the invention, the need for release agent (typically required for producing strand-based products, such as OSB, with MDI resin) is avoided or decreasing. Having the master billets (panels) produced with MDI stick to the press platens, without the use of release agent, is thereby avoided or decreasing. There is also a decreasing likelihood of downtime associated with panels produced with MDI sticking to the press.

In employing the PTFE sheet of the invention, a lighter color top surface of the wood-based product is obtained, even while using MDI resin, because the need for release agent (typically required for producing strand-based products, such as OSB, with MDI resin) is avoided or decreasing. As such, lighter colored boards can be obtained.

In employing the PTFE sheet of the invention, cost savings can be attained, by eliminating or decreasing the use of release agents, or by decreasing the use of release agents for the top surface of the wood-based product.

In employing the PTFE sheet of the invention, a textured PTFE sheet can be employed, thereby providing a wood-based product having textured top and bottom surfaces (top from PTFE sheet and bottom from steel caul screen). The added texturing (e.g., gridded texture) on the top surface (from PTFE sheet) may be beneficial in certain markets (e.g., the roofing market), where construction workers can benefit from the increased friction derived from the textured surface, with little or no drawbacks.

In employing the PTFE sheet of the invention, a PTFE sheet can be employed having visual patterns, markings, logos, nail-grid patterns, trademarks, written indicia, etc. located therein. Such visual depictions, which can be transferred to the top surface of the wood-based product, may be beneficial to consumers, as well as advantageous from a marketing perspective.

The PTFE sheet can also exhibit relatively thermally insulative properties, which may be desirable in those applications in which the manufacture prefers to minimize the temperature of the top surface of the wood-based product.

In employing the hot press platen of the invention, a tensioning and mounting system can be utilized (with relatively limited and restricted space) to retain the PTFE sheet in position, and tension and maintain tension of the PTFE sheet without wrinkling or excessive sagging.

In employing the hot press platen of the invention for a multi-opening press, a relatively quick mounting and dismounting (about 45 minutes or less for each platen) of the PTFE sheet for each press opening can be utilized. As the PTFE sheets need to be replaced (e.g., wear and tear or due to imperfections on the surface of the PTFE sheets that can allow sticking of the PTFE sheet to the mat, board and/or resin), this can be accomplished with minimal downtime. For continuous press, a secondary belt of PTFE material would need to be installed over the continuous steel belt of the continuous press.

The wood-based product can be manufactured via a "hot press" or "in-line" method. Specifically, the PTFE sheet can be contacted with the mat (veneer or wood strands) prior to (and during) the pressing stage, thereby providing the wood-based product. As such, the PTFE sheet can withstand the conditions of any pressing stage involved in the manufacturing process. Such manufacturing conditions include time, temperature, and pressure.

BRIEF DESCRIPTION OF THE FIGURES

Embodiments of the invention may be best understood by referring to the following description and accompanying drawings which illustrate such embodiments. The numbering scheme for the Figures included herein are such that the leading number for a given reference number in a Figure is associated with the number of the Figure. For example, a platen can be located in FIGS. 1 and 2. However, reference numbers are the same for those elements that are the same across different Figures. In the drawings.

DETAILED DESCRIPTION OF THE INVENTION

The present invention provides for wood-based products (e.g., OSB, PB, MDF and/or HDF), methods of manufacturing wood-based products, articles of manufacture employed in the manufacturing of wood-based products (e.g., PTFE sheet configured to be attached to a platen and/or platen configured to attach a PTFE sheet), systems used in the manufacturing of wood-based products (e.g., platens having PTFE sheet attached thereto), methods of using such articles of manufacture, and methods of using such systems.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The present invention relates to novel methods of manufacturing wood-based products, and to novel articles of manufacture useful in such processes. Referring to FIGS. 1-4, articles of manufactured used in methods of making wood-based products are provided.

Figure 1:
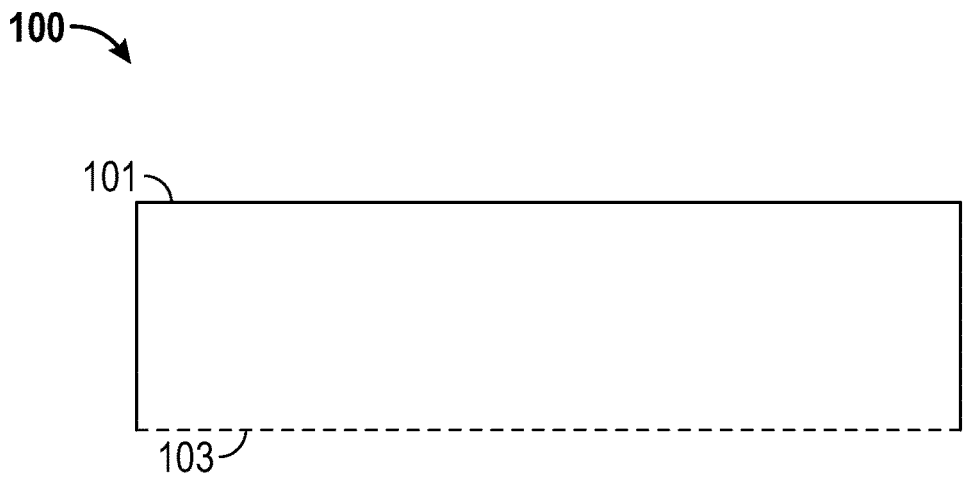
FIG. 1 illustrates a cross-sectional view of a platen of the present invention.

FIG. 1 illustrates a platen (100), having a top surface (101) and a bottom surface (103). The bottom surface (103) of the platen (100) is configured for attaching the PTFE sheet (note: configuration of bottom surface (103) of the platen (100) not illustrated).

Figure 2:
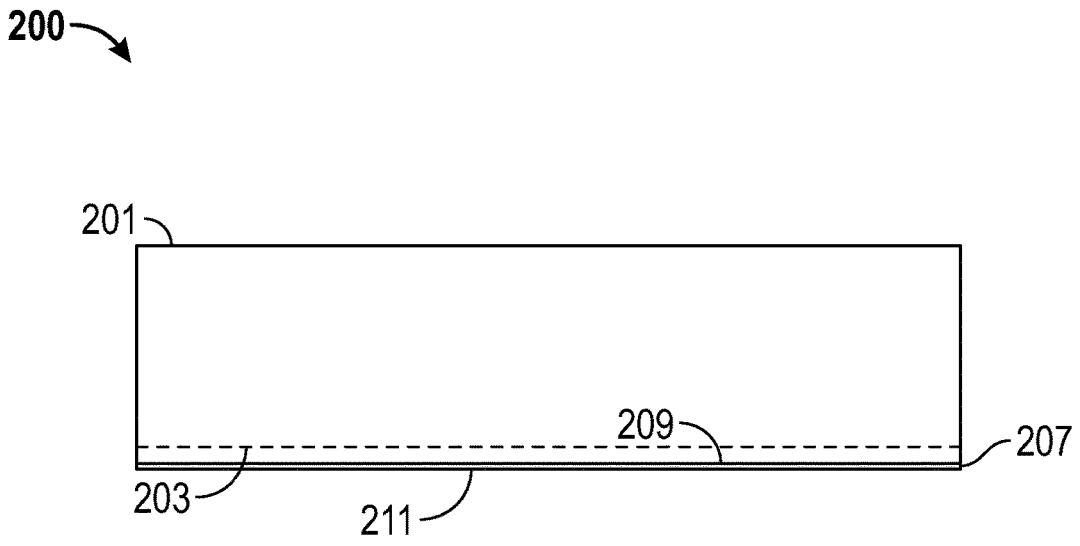
FIG. 2 illustrates a cross-sectional view of a platen of the present invention.

As illustrated in FIG. 2, the bottom surface (203) of the platen (200) has a PTFE sheet (207) attached. Specifically, the PTFE sheet is attached to the press platen (200) such that the top surface (209) of the PTFE sheet (207) faces the bottom surface (203) of the platen (200).

Figure 3:
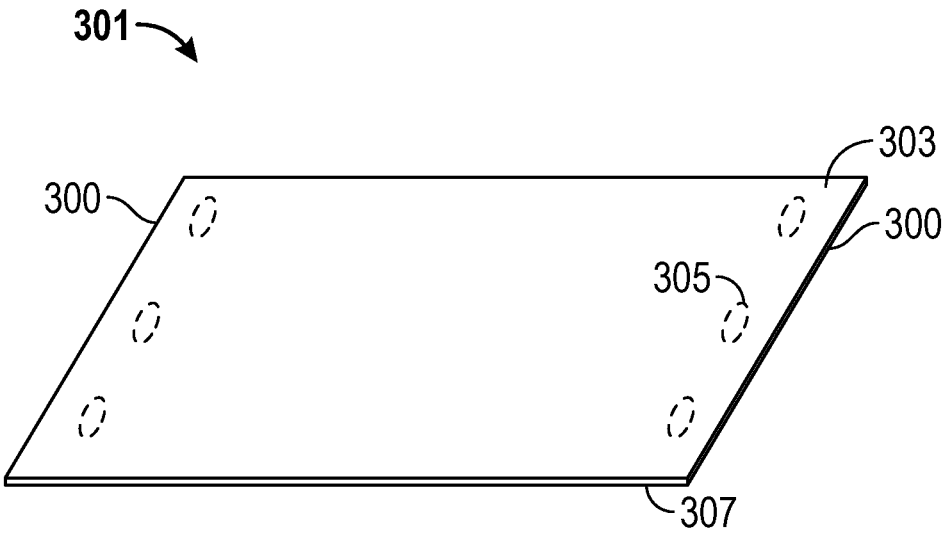
FIG. 3 illustrates a PTFE sheet of the present invention.

As illustrated in FIG. 3, a PTFE sheet (301) is provided. The PTFE sheet can include a substrate that can withstand the conditions of a hot press. Suitable substrates include, e.g., a para-aramid synthetic fiber of the formula [—CO—$C_6H_4$—CO—NH—$C_6H_4$—NH—]$_n$, commercially available under the trademark Kevlar®, spun into a fabric sheet; a steel sheet or plate, or a woven high temperature resistant fiberglass fabric. The substrate of the PTFE sheet (301) is coated on one side or both sides with PTFE. The specific substrate can be selected to provide a PTFE sheet (301) having the suitable requisite physical characteristics (e.g., tensile strength, flexibility, ability to withstand the time, temperature and pressure typically associated with the hot press, continuous use, lack of separation with PTFE, etc.).

All or part of the outer side (309) of the PTFE sheet (301) (see, FIG. 3) can be reinforced. The substance used for the reinforcement can be the same as, or different from, the substrate. For example, the PTFE sheet (301) can be reinforced by applying a suitable material (e.g., a fabric sheet, steel sheet, or fiberglass fabric) to part (or all) of the outer side (309) of the PTFE sheet (301). Because the outer side (309) of the PTFE sheet (301) does not significantly contact the bottom surface of the platen (203) during use, there is a minimal likelihood that MDI will come into contact with the outer side (309) of the PTFE sheet (301).

In specific embodiments, both sides (top surface (303) and a bottom surface (307)) of the PTFE sheet (301) can include the PTFE coating. Although only one surface will contact the wood-based product during use, that surface may become damaged over time, for example, from continued use. Having both surfaces of the PTFE sheet (301) be coated with the PTFE will allow the user to relatively quickly and efficiently reorient the PTFE sheet (301), thereby allowing the user to access the opposing side for use.

The PTFE sheet (301) includes a top surface (303) and a bottom surface (307). The PTFE sheet (301) also includes a pair of outer sides (309). The PTFE sheet (301) also includes one or more openings (305), each located toward the outer sides (309) of the PTFE sheet (301).

Polytetrafluoroethylene (PTFE) or poly(difluoromethylene) is a synthetic fluoropolymer of tetrafluoroethylene known under the brand name Teflon®. PTFE is a fluorocarbon solid, as it is a high-molecular-weight compound consisting wholly of carbon and fluorine. PTFE is hydrophobic: neither water nor water-containing substances wet PTFE, as fluorocarbons demonstrate mitigated London dispersion forces due to the high electronegativity of fluorine. PTFE has one of the lowest coefficients of friction against any solid. PTFE can be represented structurally as follows:

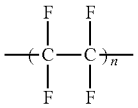

PTFE is very non-reactive, partly because of the strength of carbon-fluorine bonds, and so it is often used in containers and pipework for reactive and corrosive chemicals. Where used as a lubricant, PTFE reduces friction, wear, and energy consumption of machinery.

PTFE is typically manufactured by the polymerization of tetrafluoroethylene:

$$nF_2C{=}CF_2 \rightarrow -\{F_2C-CF_2\}-$$

Other polymers with similar composition are also known by the Teflon® trade name include perfluoroalkoxy (PFA) and fluorinated ethylene propylene (FEP). These substances retain the useful properties of PTFE of low friction and non-reactivity, but are more easily formable. For example, FEP is softer than PTFE and melts at 260° C. (500° F.); it is also highly transparent and resistant to sunlight.

Additional information regarding the Teflon® fluoropolymer resins can be found, for example, at the DuPont website (www2.dupont.com/Teflon Industrial/en_US/products/product_by_namelindex.html) (Mar. 12, 2012).

Figure 4:
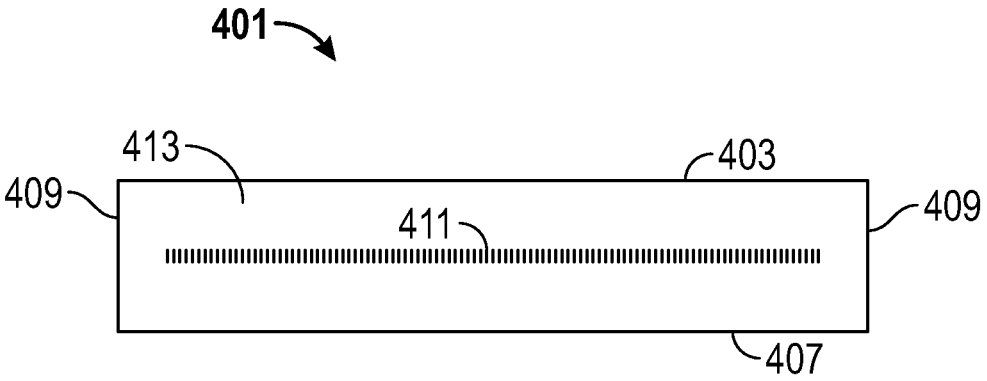
FIG. 4 illustrates a cross-sectional view of a PTFE sheet of the present invention.
Figure 5:
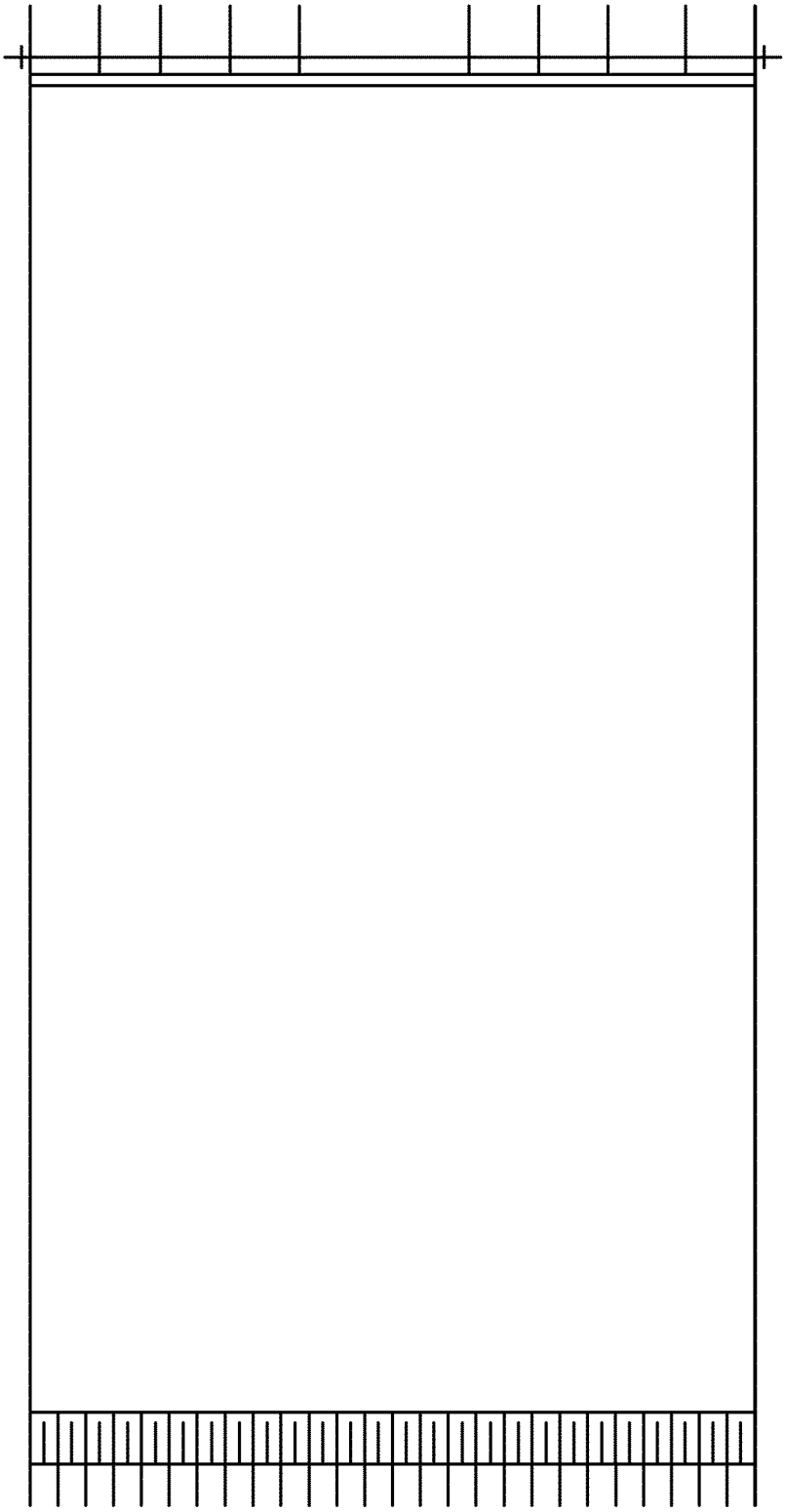
FIGS. 5 to 18 illustrate manufacturing equipment useful for manufacturing the PTFE sheet of the present invention.
Figure 6:
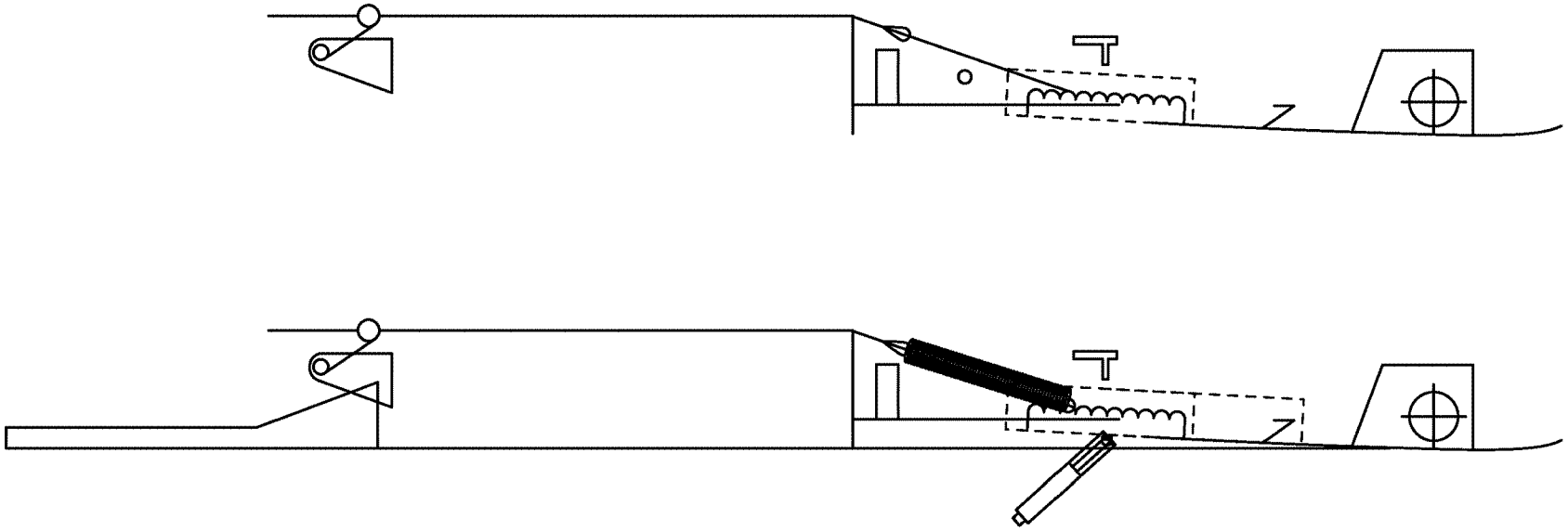
Figure 7:
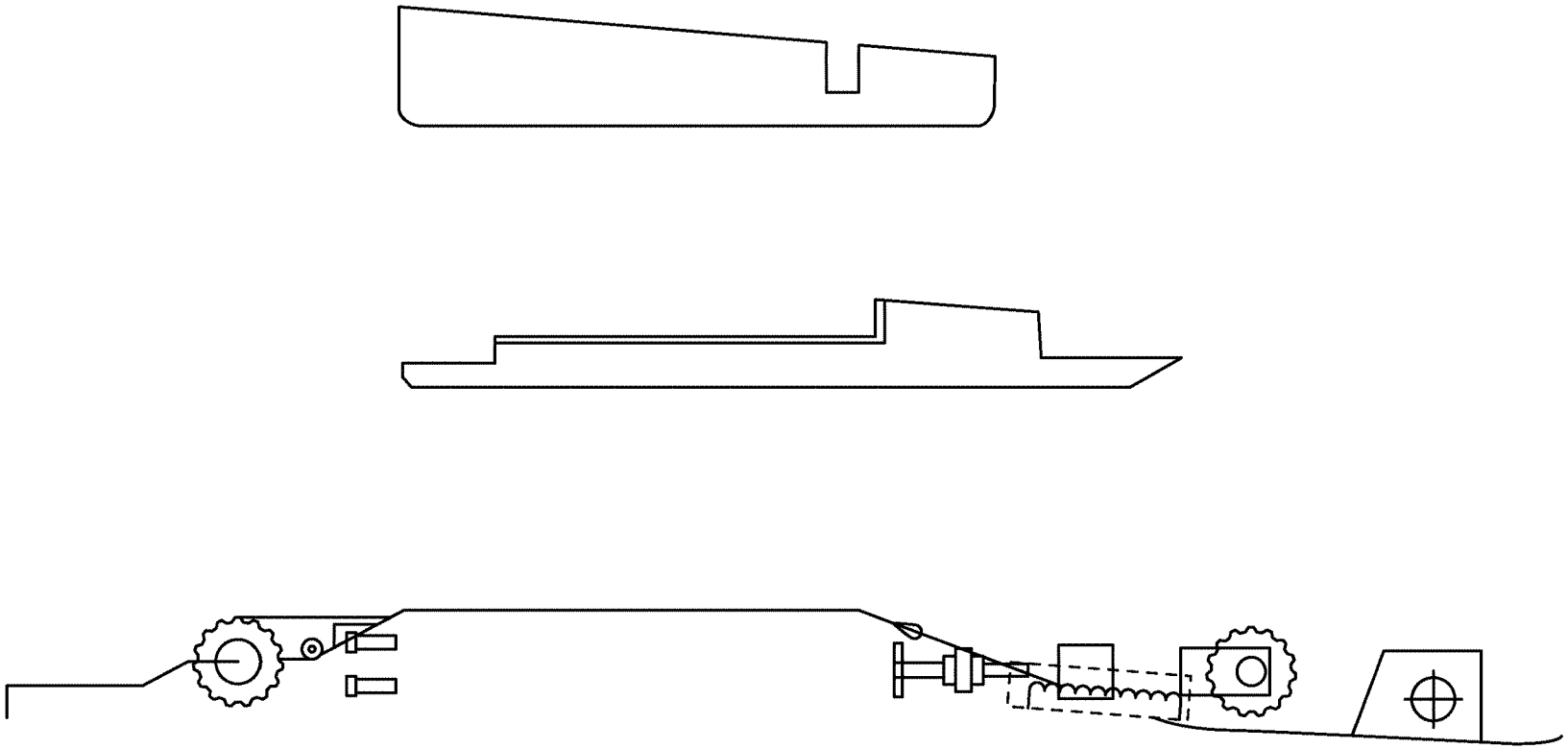
Figure 8:
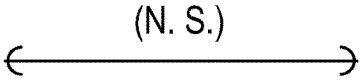
Figure 9:
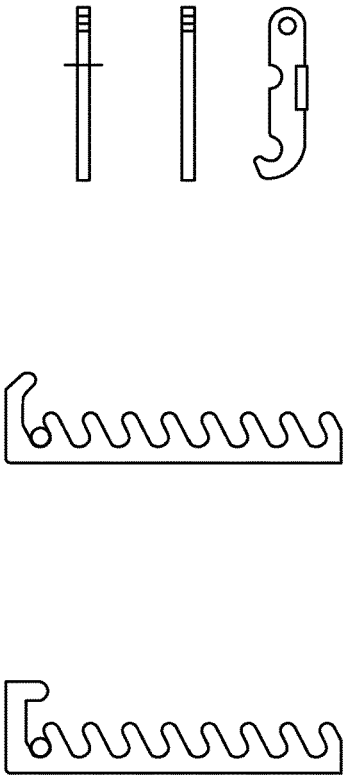
Figure 10:
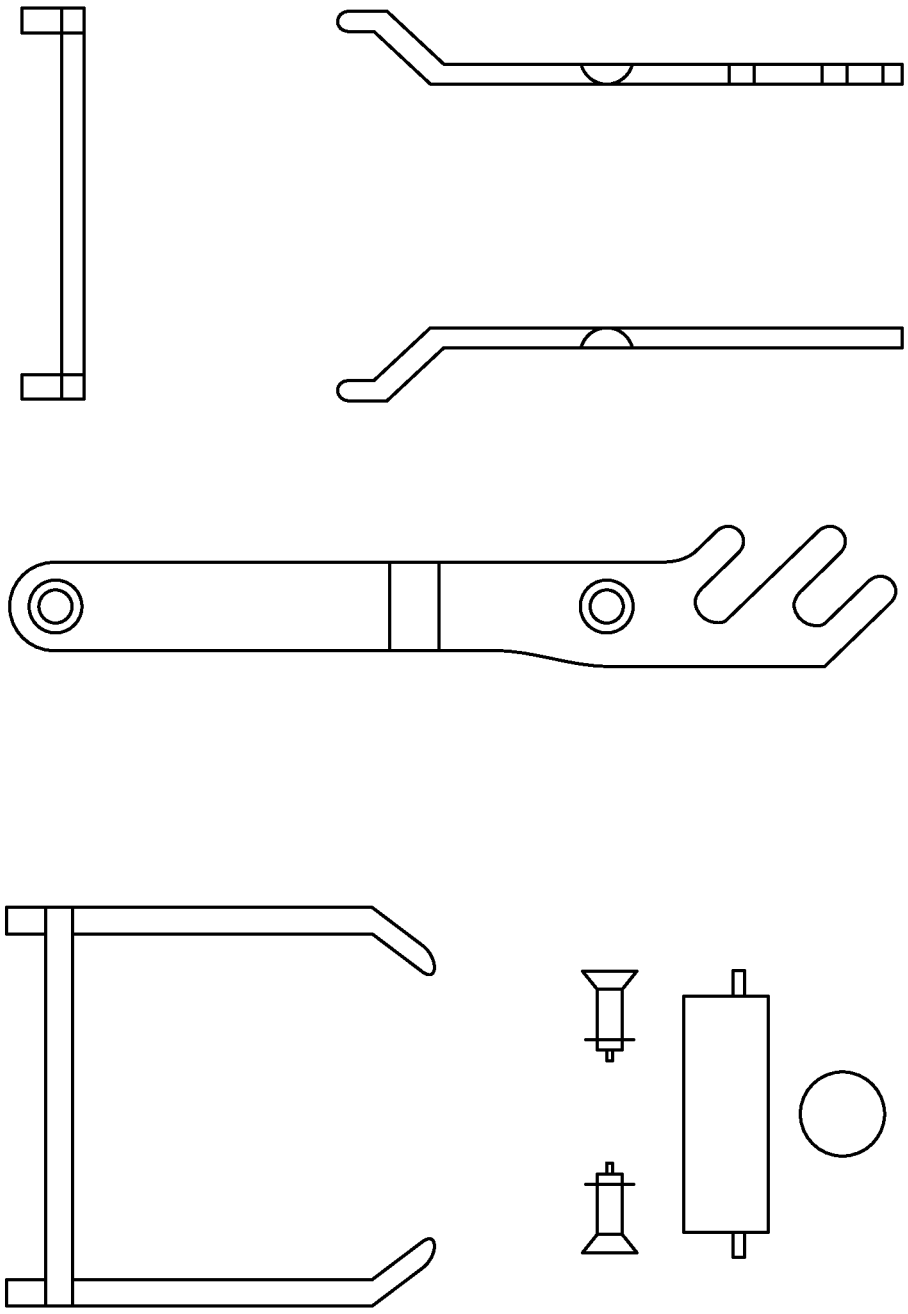
Figure 11:
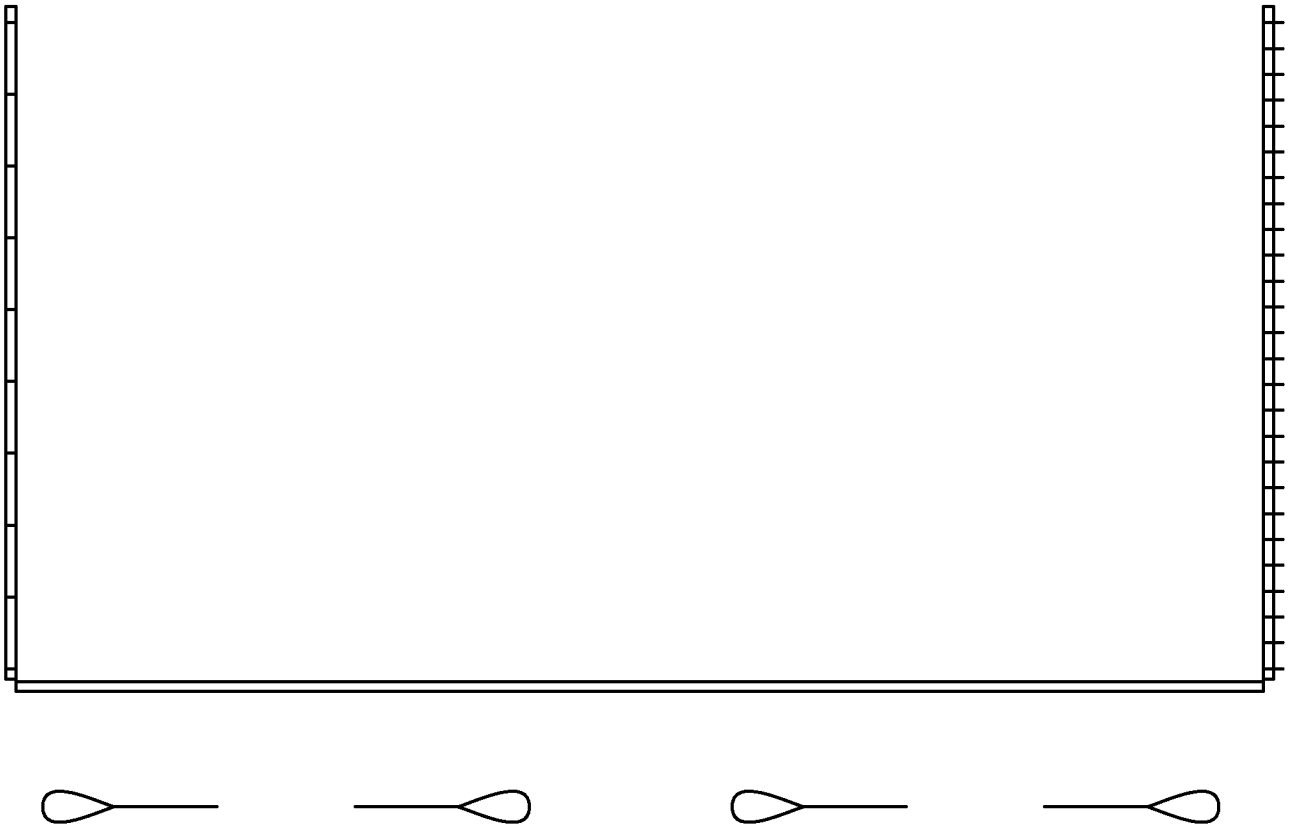
Figure 12:
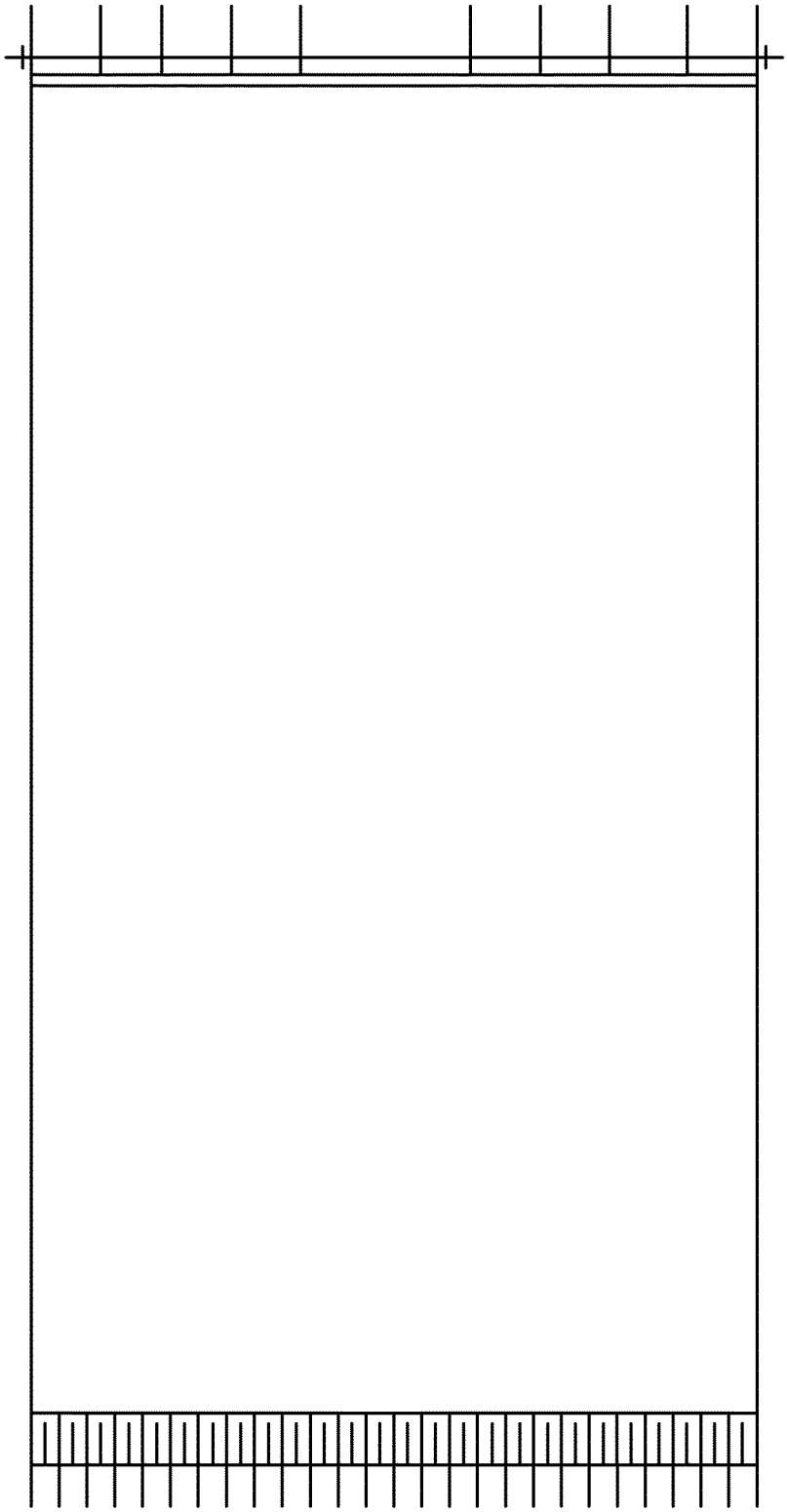
Figure 13:
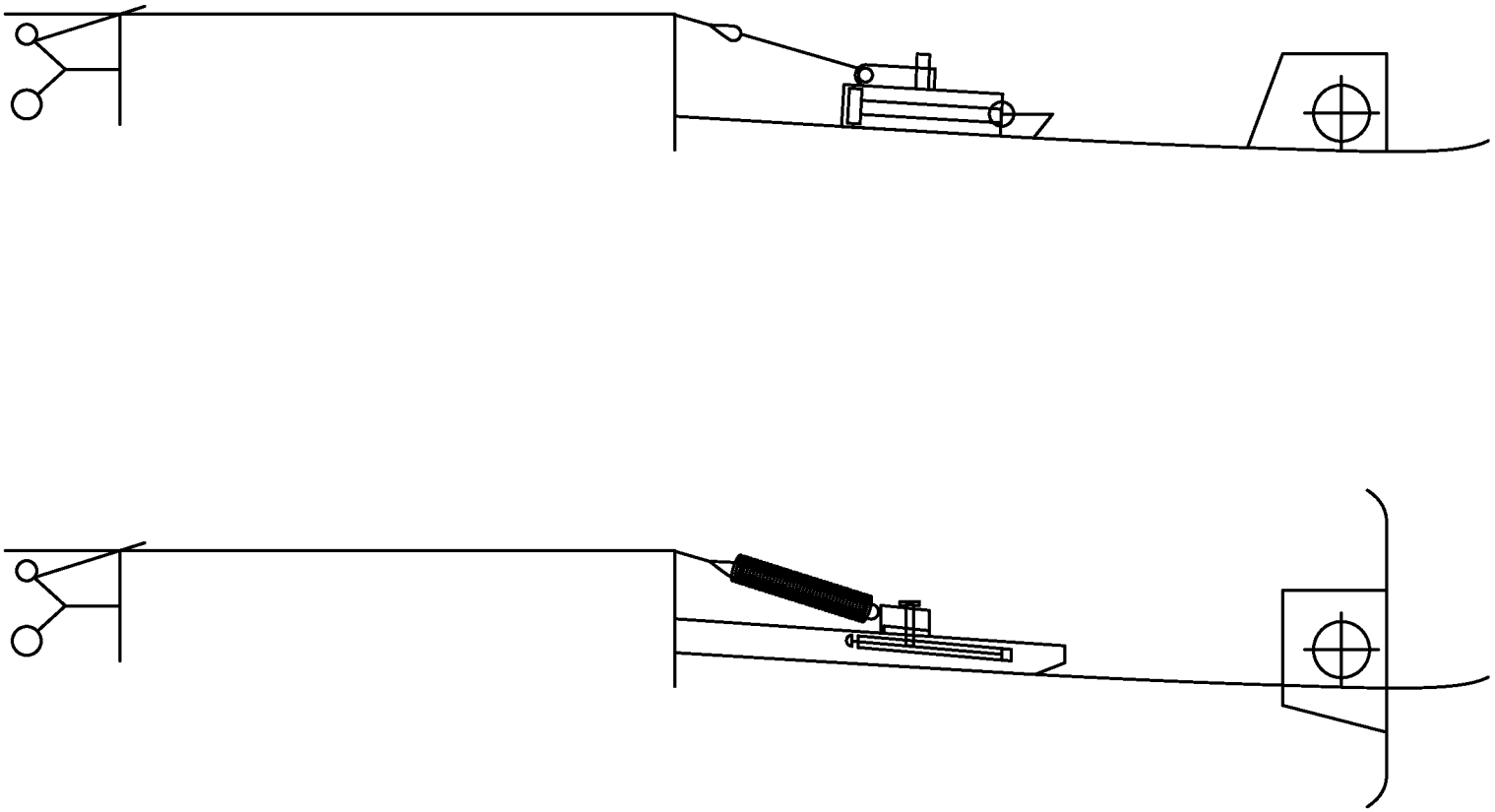
Figure 14:
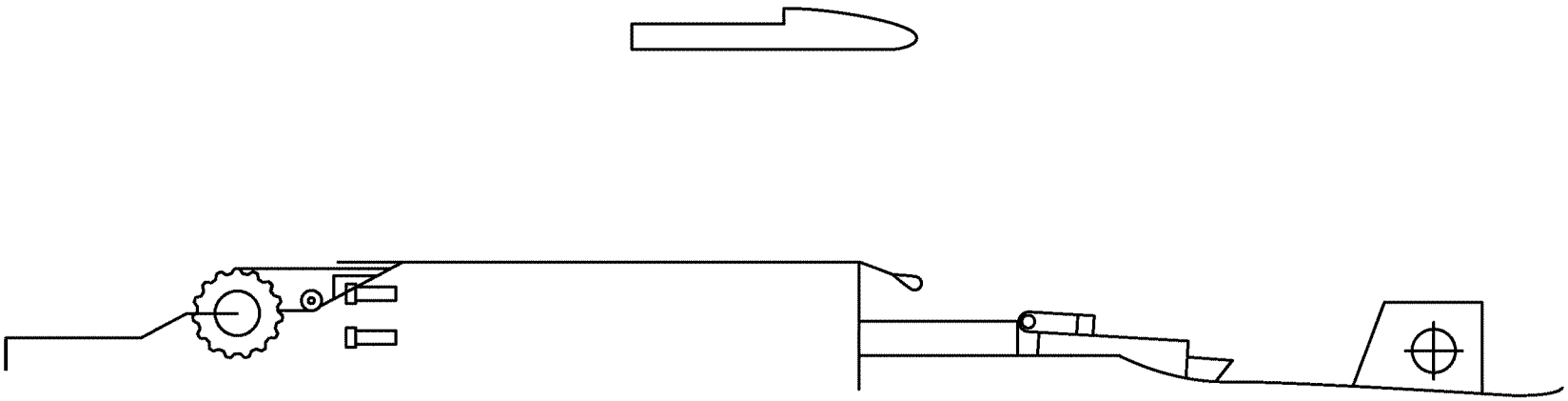
Figure 15:
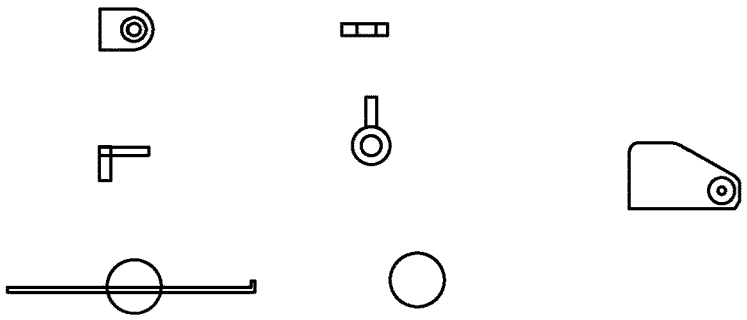
Figure 16:
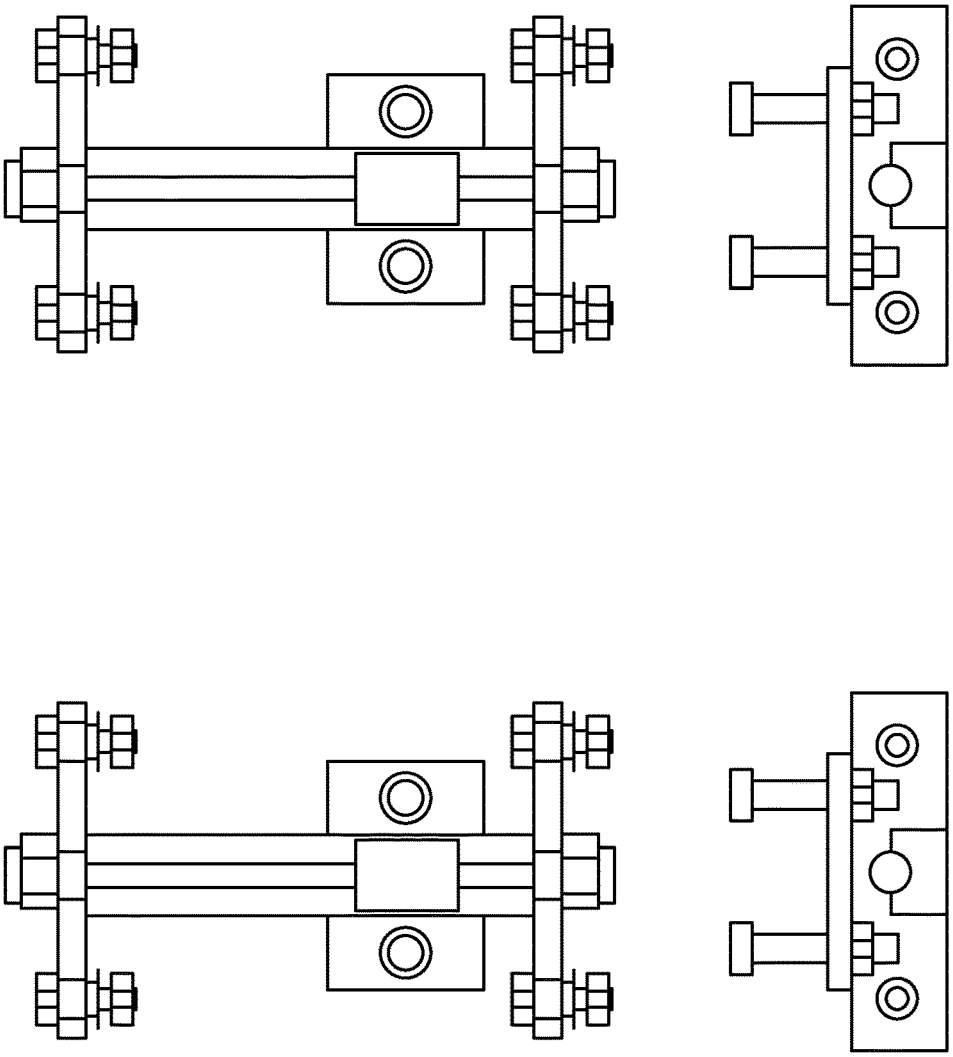
Figure 17:
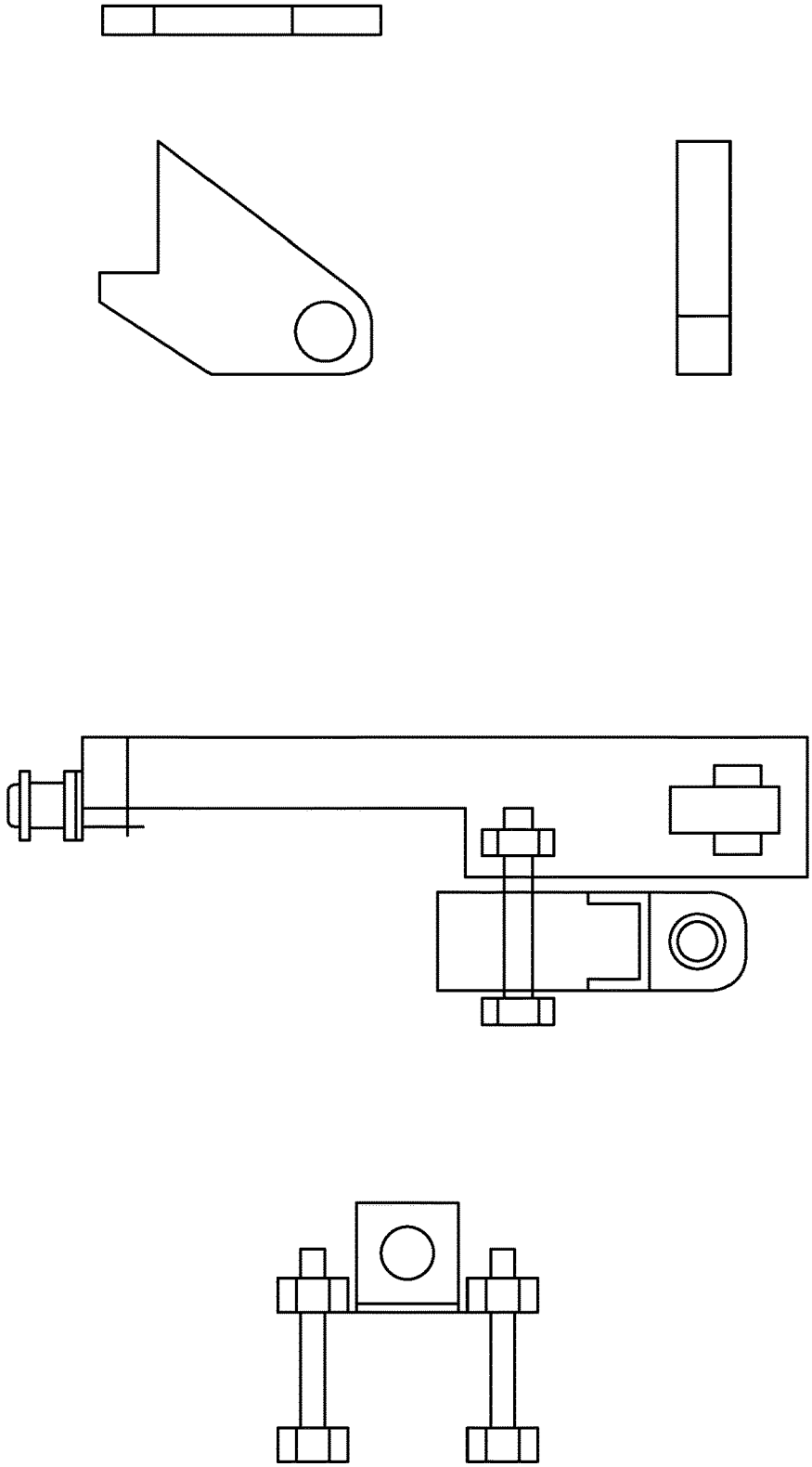
Figure 18:
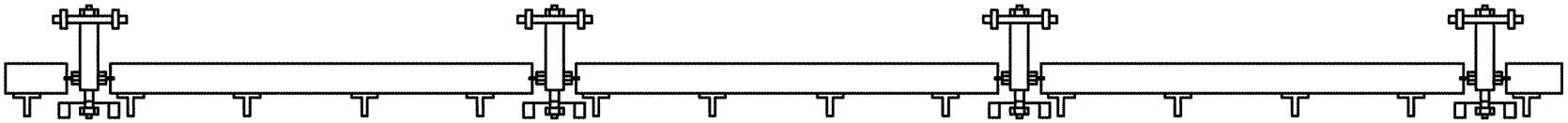

As illustrated in FIG. 4, a PTFE sheet (401) is provided. The PTFE sheet (401) includes a substrate (411) and PTFE (413). The PTFE sheet (401) is physically dimensioned such that it includes a top surface (403), a bottom surface (407) and outer sides (409).

The substrate (411) can have any suitable size and shape. For example, the substrate (411) can have a thickness of at least about 1% the thickness of the overall PTFE sheet (401), at least about 10% the thickness of the overall PTFE sheet (401), at least about 50% the thickness of the overall PTFE sheet (401), or at least about 75% the thickness of the overall PTFE sheet (401). In specific embodiments, the substrate (411) can have a thickness of up to about 90% the thickness of the overall PTFE sheet (401), up to about 50% the thickness of the overall PTFE sheet (401), up to about 25% the thickness of the overall PTFE sheet (401), or up to about 10% the thickness of the overall PTFE sheet (401).

In specific embodiments, the substrate (411) can have a length of at least about 10% the length of the overall PTFE sheet (401), at least about 50% the length of the overall PTFE sheet (401), at least about 75% the length of the overall PTFE sheet (401), or at least about 90% the length of the overall PTFE sheet (401). In further specific embodiments, the substrate (411) can have a length of up to about 99% the length of the overall PTFE sheet (401), up to about 98% the length of the overall PTFE sheet (401), up to about 97% the length of the overall PTFE sheet (401), or up to about 96% the length of the overall PTFE sheet (401).

The PTFE can exist in the form of a sheet. The PTFE sheet can have any physical dimension, suitable in the "hot press" stage for the manufacturing of the wood-based product. For example, the PTFE sheet can have a thickness of up to about 0.5 inches, up to about 0.1 inches, up to about 0.05 inches, up to about or up to about 0.03 inches, or up to about 0.01 inches. In one specific embodiment, the thickness can be 30/1,000 of an inch, ±10%.

In specific embodiments, the thickness of the PTFE sheet can be relatively non-uniform, such that there is an appreciable and significant variation of the thickness of the PTFE sheet, from any one part of the PTFE sheet to another. Alternatively, in specific embodiments, the thickness of the PTFE sheet can be relatively uniform. For example, in such specific embodiments, the variation of the thickness of the PTFE sheet can be within about ±10%, within about ±5%, or within about ±1%, from any one part of the PTFE sheet to another.

Given their utility in the manufacturing of wood-based products, the PTFE sheet can have a length and width commensurate with the platen size of the press. For example, for use with a multi-opening hot press having 12, 14 or more openings; the PTFE sheet has a length and width to cover the press platen length of 16, 24, 26, 32 feet and platen width of 4, 8, 9 and 12 feet. Of course, while the length and width of the PTFE sheet will in part be dependent upon the platen size of the hot press, so too will the platen size of the hot press be in part dependent upon the length and width of the wood-based product. As such, the PTFE sheet described herein will be useful in the "hot press" stage for the pressing master billets or panels of the dimensions of 8' by 24', 9' by 24', 12' and 24' and other sizes.

The PTFE sheet described herein can have a weight of up to about 150 lbs, up to about 100 lbs, or up to about 75 lbs. In specific embodiments, the PTFE sheet can have a weight of about 50 lbs to about 150 lbs. In other specific embodiments, the PTFE sheet can have a weight of about 75 lbs, ±10%.

PTFE sheets having the above dimensions can be handled relatively easily, such that they can be rolled and unrolled, with little or no creasing, wrinkling, and/or folding.

In specific embodiments, the PTFE sheet (on the surface that contacts the wood-based product) can include a textured pattern. The textured pattern can provide for a wood-based product having a similar pattern (on the surface that contacts the PTFE sheet).

For example, many OSB products will include a flat and smooth surface on the side that contacts the top portion of the hot press, and a textured surface on the side that contacts the bottom portion of the hot press. This is so because the bottom portion of the hot press typically includes a steel screen for transporting the mat into the press, which is textured. The texturing is transferred to the bottom surface of the wood-based product. Additionally, the top portion of the hot press typically includes a platen, which includes a relatively flat metallic surface. Likewise, this smooth surface is transferred to the top surface of the wood-based product. The ability to manufacture a wood-based product having textured surfaces on the two opposing sides may be beneficial in certain markets (e.g., the roofing market), where construction workers can benefit the increased friction or traction derived from the textured surface, with little or no drawbacks and with textured surface on both sides, either side of the panels can be used facing up in roof construction (particularly in pitched roof construction).

Additional suitable patterns that can be presented on the PTFE sheet (and transferred to the wood-based product) include, e.g., visual patterns, visual designs, markings, logos, trademarks, nail-grid patterns, visual instructions, written instructions, manufacturing designs, written indicia, etc.

Additional information regarding the PTFE sheet can be obtained, e.g., from the Taconic website (www.4taconic.com/en/) (Mar. 12, 2012).

As used herein "platen" refers to the top portion of a hot press opening. Within the context of wood-based product manufacturing, e.g., a platen will include a relatively flat metallic surface, that is manufactured to withstand the conditions (e.g., elevated pressure, elevated temperature, and time) associated with the wood-based product manufacturing.

As used herein, a "screen" refers to bottom portion of a hot press opening, and within the context of wood-based product manufacturing, includes, e.g., a caul screen that moves over rollers and/or conveying belts. While the screen will also be manufactured to withstand the conditions (e.g., elevated pressure, elevated temperature, and time) associated with the wood-based product manufacturing, such temperature and pressure conditions are lower, compared to the top portion of the hot press. The screen is also relatively flexible, in comparison to the platen.

Additionally, during the manufacture of wood-based products, the use of a small amount of release agent on the caul screen will assure that resins such as MDI typically do not bond, adhere or stick to the bottom portion of the hot press. This is so in part because a screen (having numerous apertures) is typically present on the bottom surface of the hot press.

The present invention includes PTFE sheets configured to be attached to a hot press platen. The present invention also includes PTFE sheets that are (reversibly or irreversibly) attached to a hot press platen. In specific embodiments, the user may prefer that the PTFE sheets be irreversibly attached to the hot press platen. In alternative embodiments, the user may prefer that the PTFE sheets be reversibly attached to the hot press platen.

The specific manner in which: (1) PTFE sheets are configured to be attached to a hot press platen, (2) hot press platen is configured to be attached to PTFE sheets, (3) PTFE sheets are reversibly attached to the hot press platen, (4) PTFE sheets are configured to be reversibly attached to a hot press platen, (5) hot press platen is configured to be reversibly attached to PTFE sheets, (6) PTFE sheets are configured to be irreversibly attached to a hot press platen, (7) hot press platen is configured to be irreversibly attached to PTFE sheets, will depend, in part, upon consumer preference. Any relatively effective, safe, convenient, quick and/or cost-effective type of connection can be utilized, which includes, e.g., use of magnets, vacuum, partial vacuum, screws, nuts, bolts, fasteners, springs, hooks, flexible connectors, terminals, pins, turnbuckles, latches, clamps, threaded couplings, compression couplings, quick lock couplings, anchors, clips, loop fasteners, quick connect fasteners, mechanical fasteners, inserts, latches, springs, rivet nuts, eyelets, etc. Additional types of connections are disclosed, e.g., in www.e-how.com/list_6864961_various-types-coupling-used-machines.html (Mar. 21, 2012), compass.seacadets.org/pdf/nrtc/an/14014ch5.pdf (accessed Mar. 21, 2012), www.globalspec.com/productfinder/mechanical_components/mechanical_fasteners (accessed Mar. 21, 2012), www.globalspec.com/leammore/mechanical_components/mechanical_fasteners/quick_connect_fasteners (accessed Mar. 21, 2012), mdmetric.com/fastind:x/fastener/fastovrvw.pdf (accessed Mar. 21, 2012), and www.fastener-group.com/Mechanical.html (accessed Mar. 21, 2012).

In specific embodiments of the invention, the PTFE sheets are configured to be reversibly attached to the hot press platen. In additional specific embodiments of the invention, the PTFE sheets are reversibly attached to the hot press platen. The PTFE sheets can be configured to be reversibly attached to the hot press platen, e.g., with the use of one or more openings (305) located on the PTFE sheet. The one or more openings (305) can be located toward the outer side (309) of the PTFE sheet (e.g., toward the opposingly faced outer sides (309) of the PTFE sheet).

The PTFE sheet can include any suitable number of openings (305). For example, the PTFE sheet can include up to about 20, up to about 10, or up to about 5 openings (305). Additionally, each of the openings can independently have any suitable size and configuration. For example, each of the openings (305) can independently have a size of up to about 100 $in^2$, up to about 25 $in^2$, up to about 4 $in^2$ or up to about 2 $in^2$. Additionally, each of the openings (305) can independently have a configuration of circular, elliptical, semi-circular, semi-elliptical, spherical, semi-spherical, square or rectangular.

In specific embodiments, the uses of springs and ratchets have been employed in reversibly attaching the PTFE sheet to the hot press platen, which have been found to minimize the amount of sagging of the PTFE sheet. The use of springs and ratchets have also been found to minimize the occurrences of creasing or wrinkling of the PTFE sheets (which can cause undesirable marks on the top surface of the wood-based composite). The use of springs and ratchets (with an appropriate PTFE sheet stiffness or basis weight)

have also been found to minimize the occurrences of undesirable bubbles on the top surface of the wood-based composite.

In specific embodiments of the invention, the hot press platen having the PTFE sheet attached thereto, will exhibit a minimal amount of sagging of the PTFE sheet (e.g., due to the level of heat and/or pressure typically experienced in the pressing stage). For example, the approximate center of the PTFE sheet can extend or droop down within about 12 inches below the bottom plane of the platen (top portion of the hot press). In further embodiments, the approximate center of the PTFE sheet can extend or droop down within about 2 inches below the bottom plane of the platen (top portion of the hot press). In further embodiments, the approximate center of the PTFE sheet can extend or droop down within about 1 inch below the bottom plane of the platen (top portion of the hot press). In further embodiments, the approximate center of the PTFE sheet can extend or droop down within about 0.5 inch below the bottom plane of the platen (top portion of the hot press).

Typically, the PTFE sheet can be positioned horizontally across (below) the bottom surface of the top press. In specific embodiments, the PTFE sheet can be anchored to a relatively stationary support on one side of the press, and anchored to springs with a ratchet mechanism on the opposing side of the press. This will allow for the relatively quick mounting and dismounting, especially in those situations in which a relatively limited and restricted space is available.

As used herein, a "wood-based product" or "panel" refers to a structural or non-structural product formed from a variety of materials including wood and/or wood substrate products (e.g., flakes or strands of wood, particles or particle strands of wood, fines or fines of wood, as well as veneers or veneers of wood). These materials are optionally formed from moisture-containing substrates, permeable substrates, and substrates which are both moisture-containing and permeable. Suitable wood-based products include, e.g., particle board (PB), oriented strand board (OSB), medium density fiberboard (MDF), Oriented Strand Lumber (OSL), Laminated Strand Lumber (LSL), and Parallel Strand Lumber (PSL).

The wood-based product will include a pair of oppositely facing outer surfaces that define the wood-based product. As with any rectangular prism, the wood-based product more precisely and accurately includes six outer surfaces (i.e., three pairs of oppositely facing surfaces). As such, as used herein a "pair of outer surfaces" or a "pair of oppositely facing outer surfaces" of the wood-based product refers to the pair of outer surfaces or the pair of oppositely facing outer surfaces of the wood-based product having the largest surface areas. It is appreciated that those of skill in the art understand that the wood-based product includes six outer surfaces (i.e., three pairs of oppositely facing surfaces), but reference to the wood-based product as including a pair of outer surfaces is acceptable and appropriate to those of skill in the art to refer to the pair of oppositely facing outer surfaces of the wood-based product having the largest surface areas.

As used herein, "wood-based product" refers to wood-based composite products, as described herein, in addition to dimensional lumber, timber, paneling, structural paneling, decorative paneling, wainscoting, posts, poles, and millwork lumber.

As used herein, "oriented strand board" or "OSB" refers to an engineered structural-use panel typically manufactured from thin wood strands bonded together with resin under heat, pressure, and/or radiant energy. The strands are typically dried, blended with resin and wax (e.g., paraffinic wax, microcrystalline wax, and mixtures thereof), and formed into thick, loosely consolidated mats or blankets that are pressed under heat and pressure into large panels. The strands in the core layers are usually aligned substantially perpendicular to the strand alignment of the face layers, like the cross-laminated veneers of plywood.

It is appreciated that those of skill in the art understand that OSB is typically characterized by those starting materials or intermediate components (e.g., resin and flakes of wood) that are useful in making the OSB. While these materials may undergo a substantial conversion during the manufacturing of the OSB, reference to OSB as including these materials or components is acceptable and appropriate to those of skill in the art. For example, the flakes of wood and the resin, during the pressing step (e.g., curing), can undergo a chemical and/or physical conversion, such that they may no longer expressly and literally meet the criteria to be classified as flakes of wood and resin, respectively. Reference to the OSB as including a resin and flakes of wood is, however, acceptable and appropriate to those of skill in the art. As such, as used herein, "oriented strand board" includes resin(s) and flakes of wood.

Suitable OSB, and methods for making the same, are disclosed, e.g., in U.S. Pat. Nos. 7,485,286; 7,404,918; 7,378,044; 7,264,796; 6,333,097; 6,136,408; 6,098,679; 5,718,786; 5,525,394; 5,470,631; 5,443,894; 5,425,976; 5,379,027; and 4,364,984.

As used herein, a "flake" refers to a thin strand of wood that is produced from a flaker or strander. In addition, as used herein, a "green flake" refers to a flake that has not been dried. The flake can have any suitable size, provided the flake can be effectively cured with a suitable resin. For example, the flake can typically have a length (y-dimension) of up to about 12 inches (30.4 cm), or about 4.5 inches (11.4 cm) to about 6.0 inches (15.2 cm); and can typically have a width (x-dimension) of up to about 12 inches (30.4 cm), or about 1.5 inches (3.8 cm) to about 2.5 inches (6.4 cm). Likewise, the flake can typically have a thickness (z-dimension) of about 0.001 inches (0.0025 cm) to about 0.10 inches (0.254 cm), about 0.010 inches (0.0254 cm) to about 0.060 inches (0.1524 cm), or about 0.020 inches (0.0508 cm) to about 0.035 inches (0.089 cm). Typically, the width of the flake will be a function of the length of the flake. The length of the flake is typically at least about three times greater than the width of the flake, and typically no more than about ten times greater than the width of the flake. This allows for proper flake orientation and provides an OSB with acceptable physical properties.

As used herein, "blanket of flakes" refers to a plurality or mass of flakes having a discrete or continuous length, width, and height. The blanket of flakes can be formed, e.g., on a mat or a screen. A cross-sectional view of the blanket of flakes will typically illustrate that the flakes exist in multiple layers, thereby forming the blanket of flakes. The blanket of flakes can have a discrete length, width, and height. The blanket of flakes can typically have a width of up to about 16 feet, of up to about 12 feet, up to about 9 feet, up to about 8 feet, or up to about 4 feet; a length of up to about 48 feet, of up to about 36 feet, or up to about 24 feet; and a thickness of up to about 3 feet, of up to about 2 feet, of up to about 1 foot, of up to about 8 inches, of up to about 6 inches, or of up to about 2 inches.

In another embodiment of the present invention, the blanket of flakes can have a discrete width, a discrete height, and a continuous length. In such an embodiment, the mat length or screen length can be greater than about 10 feet, greater than about 20 feet, or greater than about 40 feet. Such a mat or screen is typically referred to as a "continuous mat" or "continuous screen." The length of the blanket of flakes in such embodiment can typically be greater than about 10 feet, greater than about 20 feet, or greater than about 40 feet. In such an embodiment, the blanket of flakes can typically have a width of up to about 16 feet, up to about 12 feet, up to about 9 feet, up to about 8 feet, or up to about 4 feet; and a thickness of up to about 3 feet, of up to about 2 feet, up to about 1 foot, up to about 8 inches, up to about 6 inches, or up to about 2 inches.

As used herein, "blanket of oriented flakes" refers to a blanket of flakes, as used herein, wherein each layer has flakes that are substantially perpendicular to the flakes in the layer directly below that specified layer (when present) and are substantially perpendicular to the flakes in the layer directly above that specified layer (when present).

As used herein, "particle board" refers to an engineered wood-based product typically manufactured from wood particles bonded together with resin under heat, pressure, and/or radiant energy. The particles are typically dried, blended with resin and wax, and formed into thick, loosely consolidated mats or blankets that are pressed under heat and pressure into large panels.

A used herein, "wood particles" or "fines" refer to particles of wood having an average diameter of up to about 0.05 inches, up to 0.005 inches, or up to 0.0005 inches.

As used herein, "continuous press" refers to a method of manufacturing a wood-based product wherein a press mat moves into the press in a continuous manner. Such a manner can be accomplished, e.g., by employing a series of rollers that push down upon the flakes, veneers, and/or wood particles. Those of skill in the art typically refer to a continuous press as having no mat length. It is appreciated that those of skill in the art understand that such reference is intended to refer to mats having a length, e.g., of more than about 20 feet.

As used herein, "manufacturing conditions" refers to those conditions (e.g., time, temperature, and pressure) involved in any of the steps in the manufacturing of a wood-based product. Those steps include, for example, the pressing stage.

As used herein, "elevated temperature" refers to any temperature above room temperature, 77° F. (25° C.). Typically, the elevated temperature can be above about 100° C. (212° F.), above about 150° C. (302° F.), above about 200° C. (392° F.), or up to about 250° C. (482° F.). Specifically, the elevated temperature can be about 25° C. (77° F.) to about 315° C. (599° F.), about 100° C. (212° F.) to about 315° C. (599° F.), about 25° C. (77° F.) to about 218° C. (425° F.), about 100° C. (212° F.) to about 218° C. (425° F.), or about 175° C. (374° F.) to about 218° C. (425° F.).

Specifically, regarding oriented strand board (OSB) and methods for making the same, "elevated temperature" can be about 162° C. (325° F.) to about 246° C. (475° F.), about 177° C. (350° F.) to about 232° C. (450° F.), or about 191° C. (375° F.) to about 218° C. (425° F.). Specifically, regarding plywood and methods for making the same, "elevated temperature" can be about 107° C. (225° F.) to about 218° C. (425° F.), about 121° C. (250° F.) to about 204° C. (400° F.), or about 135° C. (275° F.) to about 191° C. (375° F.).

As used herein, "elevated pressure" refers to any pressure above standard pressure, 1 atm. (14.7 psi). Typically, the elevated pressure can be above about 5.0 atm (73.5 psi), above about 10.0 atm (146.9 psi), above about 20.0 atm (293.9 psi), above about 40.0 atm (587.8 psi), or above about 80.0 atm (1175.7 psi). Specifically, the elevated pressure can be about 60.0 atm. (881.8 psi) to about 85.0 atm (1249 psi).

Specifically, regarding oriented strand board (OSB) and methods for making the same, "elevated pressure" can be about 25 atm. (367 psi) to about 55 atm. (808 psi), about 30 atm. (441 psi) to about 50 atm. (735 psi), about 34 atm. (500 psi) to about 48 atm. (705 psi), or about 35 atm. (514 psi) to about 45 atm. (661 psi).

Specifically, regarding plywood and methods of making the same, "elevated pressure" can be about 8.0 atm. (118 psi) to about 21 atm (309 psi) or about 10.0 atm. (147 psi) to about 17 atm (250 psi).

As used herein, "resin" refers to an adhesive polymer of either natural or synthetic origin. As used herein, a "polymer" is a compound formed by the reaction of simple molecules having functional groups that permit their combination to proceed to higher molecular weights under suitable conditions. Synthetic polymers are chemically designed and formulated into the adhesive to perform a variety of bonding functions.

As used herein, "outer surface" or "panel face" refers to the outermost boundary of a wood-based product (e.g., OSB, OSL or LSL). The outer surfaces of a wood-based product include the top surface and the bottom surface. The wood-based product will include a pair of oppositely facing outer surfaces that define the wood-based product. As with any rectangular prism, the wood-based product more precisely and accurately includes six outer surfaces (i.e., three pairs of oppositely facing surfaces). As such, as used herein a "pair of outer surfaces" or a "pair of oppositely facing outer surfaces" of the wood-based product refers to the pair of outer surfaces or the pair of oppositely facing outer surfaces of the wood-based product having the largest surface areas. It is appreciated that those of skill in the art understand that the wood-based product includes six outer surfaces (i.e., three pairs of oppositely facing surfaces), but reference to the wood-based product as including a pair of outer surfaces is acceptable and appropriate to those of skill in the art.

The wood-based product will preferably meet the necessary requirements to be certified as a wood-based product. In doing so, the wood-based product, upon testing, will be approved by the relevant building codes and insurance rating bureaus typically known to those of skill in the art. The wood-based product, upon testing, will meet or exceed the requirements of a wood-based product, as promulgated by the relevant code sections for one or more of the following entities: International Code Council (ICC); American Society for Testing Materials (ASTM); American Wood Protection Association (AWPA); Underwriters Laboratories, Inc. (UL); U.S. Department of Defense (DOD); Military Specification (Mil); City of Los Angeles, Calif.; City of New York, N.Y. Building Code; American National Standards Institute (ANSI).

OSB

An oriented strand board can be manufactured by contacting flakes of wood with a resin; orienting, in alternate lengthwise and crosswise layers, the flakes of wood to provide a blanket of oriented flakes; and curing the resin by exposing the resin to at least one of an elevated temperature, an elevated pressure, and radiant energy; for a sufficient period of time to effectively cure the resin.

Initially, logs pass through a flaker, where they are cut into thin strands (i.e., flakes) of wood. Before the logs pass through a flaker, the logs can optionally be heated, especially if the logs are below about 10° C. (50° F.). The logs can be heated in any suitable manner, provided the physical and chemical integrity of the wood is not compromised. For example, the logs can be heated in a pond of water having a temperature of up to about 80° C. (176° F.), up to about 60° C. (140° F.), or up to about 40° C. (104° F.). Specifically, the logs can be heated in a pond of water having a temperature of about 100° F. (38° C.) to about 110° F. (43° C.). In addition, the logs can be heated for more than about 1 hour. Specifically, the logs can be heated for about 1 hour to about 48 hours. Alternatively, the logs can be heated via microwave for a suitable period of time, effective to dry the logs.

After the logs are cut into thin strands (i.e., flakes) of wood, the flakes can optionally be dried to remove at least some of the water present therein. The flakes can be dried in any suitable manner, provided at least some of the water present therein is removed. For example, the flakes can be dried using a tumble dryer. The flakes can be dried under any suitable conditions (e.g., at a temperature of above about 40° C. (104° F.) for about 10 seconds or more), provided at least some of the water present therein is removed. Specifically, the flakes can be dried at about 180° F. to about 300° F. for about 8 minutes to about 10 minutes.

Upon exposure to the elevated temperature, elevated pressure, and/or radiant energy, the resin will cure, thereby adhering the flakes of wood to one another.

Species of Timber

Any suitable species of timber (i.e., wood) can be employed to make the wood-based composite product. In addition, the wood-based product can be manufactured from one or more suitable species of timber. Suitable types of timber include, e.g., Western, Northern (and Appalachian), and Southern timber.

Suitable Western timbers include, e.g., Incense-Cedar, Port-Orford-Cedar, Douglas Fir, White Fir, Western Hemlock, Western Larch, Lodgepole Pine, Ponderosa Pine, Sugar Pine, Western White Pine, Western Redcedar, Redwood, Engelmann Spruce, Sitka Spruce, Yellow-Cedar, Red Alder, Oregon Ash, Aspen, Poplar, Black Cottonwood, California Black Oak, Oregon White Oak, Big Leaf Maple, Paper Birch, and Tanoak.

Suitable Northern (and Appalachian) timbers include, e.g., Northern White Cedar, Balsam Fir, Eastern Hemlock, Fraser Fir, Jack Pine, Red Pine, Eastern White Pine, Eastern Red Cedar, Eastern Spruce, Tamarack, Ash, Aspen, Poplar, Basswood, Buckeye, Butternut, American Beech, Birch, Black Cherry, American Chestnut, Cottonwood, Elm, Hack Berry, True Hickory, Honey Locust, Black Locust, Hard maple, Soft Maple, Red Oak, White Oak, American Sycamore, Black Walnut, and Yellow-Poplar.

Suitable Southern timbers include, e.g., Atlantic White Cedar, Bald Cypress, Fraser Fir, Southern Pine, Eastern Red Cedar, Ash, Basswood, Arnecan, Beech, Butternut, Cottonwood, Elm, Hackberry, Pecan Hickory, True Hickory, Honey Locust, Black Locust, Magnolia, Soft Maple, Red Oaks, Sassafras, Sweetgum, American Sycamore, Tupelo, Black Walnut, Black Willow, and Yellow Poplar.

In one specific embodiment of the present invention, the flakes of wood can be manufactured from at least one of Balsam fir (*Abies balsamea*), Red maple (*Acer rubrum*), Silver maple (*Acer saccharinum*), Sugar maple (*Acer saccharum*), Paper birch (*Betula papyrifera*), Yellow birch (*Betula alleghaniensis*), Black ash (*Fraxinus nigra*), Green ash (*Fraxinus pennsylvanica*), Tamarack (*Larix laricina*), Black spruce (*Picea mariana*), White spruce (*Picea glauca*), Eastern white pine (*Pinus strobes*), Jack pine (*Pinus banksiana*), Red pine (*Pinus resinosa*), Balsam poplar (*Populus balsamifera*), Bigtooth aspen (*Populus grandidentata*), Eastern Cottonwood (*Populus deltoids*), Quaking aspen (*Populus tremuloides*), and American basswood (*Tilia Americana*).

Resins

As described herein, the flakes or veneers are contacted with a resin. The flakes or veneer are subsequently cured to mechanically and chemically bind the resin to the flakes. Such curing can typically be accomplished by exposing the resin and flakes or the resin and veneers to elevated temperatures, elevated pressures, and/or radiant energy (e.g., UV, electron beam, microwave, beta radiation, gamma radiation, neutron beam, proton beam, infra red, etc.) for a sufficient period of time to effectively cure the resin. The resin can optionally include a catalyst.

Upon curing, the resin can impregnate the flakes, or the resin can remain on the outer surface of the flakes. The curing provides an OSB wherein the resin is mechanically and chemically bound to the flakes. The chemical bonding results in the formation of chemical linkages between the resin and the cellulose and hemicellulose in the flakes. Such curing of the resin, therefore, effectively provides for the underlying wood-based substrate.

The resin (i.e., adhesive polymer) can either be a thermoplastic polymer or a thermosetting polymer. Thermoplastic polymers are long-chain polymers that soften and flow on heating, then harden again by cooling. They generally have less resistance to heat, moisture, and long-term static loading than do thermosetting polymers. Common wood adhesives that are based on thermoplastic polymers include, e.g., polyvinyl acetate emulsions, elastomerics, contacts, and hot-melts. Alternatively, thermosetting polymers undergo irreversible chemical change, and on reheating, they do not soften and flow again. They form cross-linked polymers that have strength, have resistance to moisture and other chemicals, and are rigid enough to support high, long-term static loads without deforming. Suitable resins that are based on thermosetting polymers include, e.g., phenolic, resorcinolic, melamine, isocyanate, urea, an epoxy resin, a phenol-formaldehyde (PF) resin, a melamine-formaldehyde (MF) resin, a phenol-melamine-formaldehyde (PMF) resin, and combinations thereof.

The suitable resin can be of natural origin, can be of synthetic origin, or can include resins of a combination thereof. Suitable resins of natural origin include, e.g., animal protein, blood protein, casein protein, soybean protein, lignocellulostic residue and extracts, bark-based resins, and combinations thereof. Suitable resins of synthetic origin include, e.g., cross-linkable polyvinyl acetate emulsion, elastomeric contact, elastomeric mastic, emulsion polymer/isocyanate, epoxy, hot melt, isocyanate, formaldehyde, melamine and melamine urea, phenolic, polyvinyl acetate emulsion, polyurethane, resorcinol and phenol resorcinol, urea, and combinations thereof. In one embodiment of the present invention, the resin can be a foaming adhesive, such as dry cow blood.

Specifically, the resin can include an isocyanate resin, a melamine resin, a phenol-formaldehyde (PF) resin, a melamine-formaldehyde (MF) resin, a phenol-melamine-formaldehyde (PMF) resin, a melamine-urea-formaldehyde (MUF) resin, a phenol-melamine-urea-formaldehyde (PMUF) resin, or a combination thereof. More specifically, the resin can be a melamine resin, e.g., phenol-melamine-formaldehyde (PMF) resin which is commercially available from ARC Resins Corporation (Longueuil, Quebec, Canada), Momentive Specialty Chemicals Inc (Columbus, Ohio), GP Resin (Atlanta, Ga.) or Arclin (Mississauga, Ontario, Canada). PMF Resin is a phenol-melamine-formaldehyde copolymer.

Any suitable isocyanate can be employed as the resin. Suitable isocyanates include, e.g., PMDI (polymethylene-dipenyl-4,4'-diisocyanate); MDI (methylene diphenyl diisocyanate), or a combination thereof. Additional suitable isocayantes are disclosed, e.g., in Aldrich Catalogue (Milwaukee, Wis.).

The phenol can optionally be substituted. Suitable substituted phenols include, e.g., alkyl substituted phenols, aryl substituted phenols, cycloalkyl substituted phenols, alkenyl substituted phenols, alkoxy substituted phenols, aryloxy substituted phenols, and halogen substituted phenols, as disclosed in U.S. Pat. No. 5,700,587. Additional suitable substituted phenols are disclosed, e.g., in U.S. Pat. No. 6,132,549.

The formaldehyde can optionally be replaced with another suitable aldehyde. Suitable aldehydes include, e.g., formaldehyde, acetaldehyde, propionaldehyde, furfuraldehyde and benzaldehyde. In general, the aldehyde employed can have the formula R'CHO wherein R' is a hydrogen or a hydrocarbon radical of 1 to about 12 carbon atoms. Specifically, the aldehyde can be formaldehyde. Suitable additional aldehydes are disclosed, e.g., in U.S. Pat. No. 5,700,587 and Aldrich Catalogue (Milwaukee, Wis.).

The resin can be a solid (e.g., powder) or a liquid. When the resin is a liquid, the liquid resin can be relatively viscous or relatively non-viscous. When the resin is a liquid and is relatively viscous, the resin can optionally be diluted with one or more carriers to render the resin relatively non-viscous. Suitable carriers include, e.g., water, organic hydrocarbons, or a combination thereof.

Additional suitable resins can be found, e.g., in the Handbook of Thermoset Plastics; Wood Handbook, sections 9-16, 9-9, 10-3, and 10-4; Forest Products Society Publications (www.forestprod.org); Wood Adhesives 2000, extended abstracts cat. No. 7260; International Contributions to Wood Adhesion Research, cat. No. 7267; Wood Adhesives 1999, cat. No. 7296; 1998 Resin Binding Seminar Proceedings, cat. No. 7266; Handbook of Pressure Sensitive Adhesive Technology, 3rd Edition by Donatas Satas, Hardcover; Handbook of Adhesive Technology, by A. Pizzi, K. L. Mittal, Hardcover; Resin Transfer Moulding, by Kevin Potter, Hardcover; and Cyanoacrylate Resins: The Instant Adhesives, by Henry L. Lee, Paperback, T/C Press, January 1986; and references cited therein.

Additional suitable resins can be found, e.g., in U.S. Pat. Nos. 6,136,408; 6,132,549; 4,758,478; 5,700,587; 5,635,118; 5,714,099; 4,364,984; 4,407,999; 4,514,532; 5,425,908; 5,552,095; 5,554,429; 5,861,119; 5,951,795; 5,974,760; 6,028,133; 6,132,885; and references cite therein.

In one specific embodiment of the present invention, the resin can include a polyolefin (e.g., polyethylene, polypropylene, or a combination thereof), alone or in combination with poly vinylacetate (PVA).

Some suitable resins are commercially available from, e.g., Momentive Specialty Chemicals Inc. (Columbus, Ohio) and ARC Resins Corporation (Longueuil, Canada).

The resin can be cured, e.g., under a suitable pressure and temperature for a sufficient period of time effective to cure the resin. The length of time will typically depend upon the desired thickness of the OSB. The length of time can be up to about 1 minute, up to about 2 minutes, up to about 3 minutes, up to about 4 minutes, up to about 5 minutes, or up to about 10 minutes. Typically, the length of time can be about 3.5 minutes to about 7.5 minutes. For example, for 3/8 inch (9.52 mm) OSB, the length of time can be about 230 seconds to about 240 seconds, for 7/16 inch (11.11 mm) OSB, the length of time can be about 230 seconds to about 240 seconds, for 15/32 inch (11.9 mm) OSB, the length of time can be about 260 seconds to about 270 seconds, for 1/2 inch (12.7 mm) OSB, the length of time can be about 280 seconds to about 290 seconds, for 5/8 inch (15.88 mm) OSB, the length of time can be about 360 seconds to about 370 seconds, and for 3/4 inch (19 mm) OSB, the length of time can be about 420 seconds to about 440 seconds.

The resin, upon curing, will preferably impart water-resistance and weather resistance upon the OSB. The resin typically employed, prior to curing, will typically not undergo chemical or physical decomposition, to any appreciable degree, such that the resin will not cure. Additionally, the resin typically employed, after curing, will remain stable throughout the subsequent OSB step(s).

The resin may require the presence of a catalyst and/or accelerator to cure the resin. Any suitable catalyst and/or accelerator can be employed, provided the resin effectively cures in a suitable period of time and the resin, upon curing, remains chemically and physically stable. Suitable catalysts include acid catalysts (e.g., formic acid), base catalysts (e.g., sodium hydroxide, calcium hydroxide, potassium hydroxide, or soda ash), salt catalysts, peroxide catalysts, and sulfur compounds. Additionally, the resin can optionally include hardeners (e.g., amine hardeners added to epoxy and formaldehyde hardener added to resorcinol) to produce cross-linking reactions to solidify the resin; antioxidants; acid scavengers; preservatives; wetting agents; defoamers; plasticizers; thickeners; and/or colorants. See, e.g., U.S. Pat. Nos. 6,132,549; 5,498,647; 5,700,587; 4,514,532; and 4,758,478.

The resin, prior to or upon curing, can impregnate the flake. Specifically, the resin, prior to or upon curing, can completely impregnate the flake (i.e., the resin is completely embedded in the flake). Alternatively, the resin, prior to or upon curing, can partially impregnate the flake. Specifically, the resin, prior to or upon curing, can impregnate up to about 1/100 of the flake, up to about 1/50 of the flake, up to about 1/10 of the flake, up to about 1/4 of the flake, up to about 1/2 of the flake, up to about 3/4 of the flake, or up to about 99/100 of the flake. More specifically, the resin, prior to or upon curing, can impregnate about 1/20 to about 1/2 of the flake.

The wood-based product can be manufactured via a "hot press" method. As such, each of the components of the wood-based product (e.g., each of the adhesive(s) and resin (s)), as well as the PTFE sheet, can withstand the manufacturing conditions of any step involved in the manufacturing process of the wood-based product.

Specifically, the wood-based product can be manufactured via a "hot press" method, wherein the PTFE sheet can be contacted with the flakes immediately prior to (or concurrently at) the pressing stage. As such, the flakes can be pressed (while contacting the PTFE sheet), at an elevated temperature and at an elevated pressure to form a wood-based product. As the flakes are pressed, and immediately thereafter, the PTFE sheet contacts at least a portion of at least one outer surface of the underlying wood-based product.

All publications, patents, website pages, and patent documents cited herein are incorporated by reference herein, as though individually incorporated by reference. The invention has been described with reference to various specific and preferred embodiments and techniques. However, it should be understood that many variations and modifications may be made while remaining within the spirit and scope of the invention.

It is appreciated that certain features of the invention, which are, for clarity, described in the context of separate embodiments, may also be provided in combination in a single embodiment. Conversely, various features of the invention which are for brevity, described in the context of a single embodiment, may also be provided separately or in any sub-combination.

What is claimed is:

1. A method of manufacturing an oriented strand board (OSB), the method comprising:

contacting flakes of wood with a resin;

orienting, in substantially alternate lengthwise and crosswise layers, the flakes of wood to provide a blanket of substantially oriented flakes;

contacting the blanket of substantially oriented flakes with a sheet comprising a substrate having a pair of opposing sides, wherein the substrate comprises at least one of a steel sheet, a steel plate, a woven high temperature resistant fiberglass fabric, and a para-aramid synthetic fiber spun into a fabric sheet, both of the opposing sides of the substrate comprise a sheet comprising polytetrafluoroethylene (PTFE), the sheet is anchored to a stationary support free of springs on one side of a hot press, and is anchored to springs with a ratchet mechanism on the opposite side of the press, and one of the opposing sides of the sheet is contacted with the blanket of substantially oriented flakes;

contacting a surface of the sheet comprising the PTFE with the top surface of the hot press; and curing the resin by exposing the resin to at least one of an elevated temperature, an elevated pressure, and radiant energy, for a sufficient period of time to effectively cure the resin.

2. The method of claim 1, wherein the sheet and hot press are configured to attach to one another employing at least one of a magnet, vacuum, partial vacuum, screw, nut, bolt, spring, hook, flexible connector, terminal, pin, turnbuckle, latch, clamp, threaded coupling, compression coupling, quick lock coupling, anchor, clip, loop fastener, insert, spring, rivet nut, and eyelet.

3. The method of claim 1, wherein the sheet and a platen of the hot press are configured to attach to one another.

4. The method of claim 1, wherein the sheet and the top surface of the hot press are attached to one another.

5. The method of claim 1, wherein the sheet is substantially planar.

6. The method of claim 1, wherein the sheet is flexible, pliable, bendable, or a combination thereof.

7. The method of claim 1, wherein the manufacturing of the oriented strand board (OSB) employs MDI (methylene diphenyl diisocyanate or diisocyanate-diphenylmethane) as a wood binder.

8. The method of claim 1, wherein the manufacturing of the OSB is carried out employing MDI (methylene diphenyl diisocyanate or diisocyanate-diphenylmethane) as a wood binder, wherein the MDI does not come into direct contact with the top portion of the hot press.

9. The method of claim 1, wherein the manufacturing of the OSB is carried out employing MDI (methylene diphenyl diisocyanate or diisocyanate-diphenylmethane) as a wood binder, wherein the MDI does not come into direct contact with the bottom surface of the platen.

10. The method of claim 1, wherein the manufacturing of the oriented strand board (OSB) is carried out in the absence of release agent.

11. The method of claim 1, wherein both of the opposing surfaces of the oriented strand board (OSB) are textured.

12. The method of claim 1, wherein the oriented strand board (OSB) includes little or no dark spots or discoloration on the surface.

13. The method of claim 1, further comprising reversibly attaching the sheet comprising the PTFE to the top surface of the hot press.

14. The method of claim 1, wherein the approximate center of the sheet comprising PTFE extends from 0.5 inches to 12 inches below the top surface of the hot press.

15. The method of claim 14, wherein the sheet comprising PTFE has a length and width sufficient to cover a platen with a length of about 16 to 32 feet and a width of about 4 to 12 feet.

16. The method of claim 1, wherein the sheet comprising PTFE has about 10 to 20 openings for reversible attachment.

17. The method of claim 16, wherein the sheet is anchored to a stationary support on one side of the press, and is anchored to springs with a ratchet mechanism on the opposite side of the press through the 10 to 20 openings.

18. The method of claim 1, further comprising reorienting the sheet in the hot press, and reperforming the method, such that the other side of the sheet is contacted with the blanket of substantially oriented flakes.

19. A method of manufacturing an oriented strand board (OSB), the method comprising:

contacting flakes of wood with a resin;

orienting, in substantially alternate lengthwise and crosswise layers, the flakes of wood to provide a blanket of substantially oriented flakes;

contacting the blanket of substantially oriented flakes with a sheet comprising a substrate having a pair of opposing sides, wherein the substrate comprises at least one of a steel sheet, a steel plate, a woven high temperature resistant fiberglass fabric, and a para-aramid synthetic fiber spun into a fabric sheet, both of the opposing sides of the substrate comprise a sheet comprising polytetrafluoroethylene (PTFE), the sheet is anchored to springs with a ratchet mechanism on one side of a hot press, and on the opposite side of the press is anchored to a support that is relatively stationary compared to the springs, and one of the opposing sides of the sheet is contacted with the blanket of substantially oriented flakes;

contacting a surface of the sheet comprising the PTFE with the top surface of the hot press; and curing the resin by exposing the resin to at least one of an elevated temperature, an elevated pressure, and radiant energy, for a sufficient period of time to effectively cure the resin.

20. The method of claim 19, further comprising reorienting the sheet in the hot press, and reperforming the method, such that the other side of the sheet is contacted with the blanket of substantially oriented flakes.

* * * * *